United States Patent [19]

Scott et al.

[11] Patent Number: 4,798,644

[45] Date of Patent: Jan. 17, 1989

[54] METHOD OF MAKING A CARPET

[75] Inventors: Richard L. Scott, Cohutta, Ga.; John J. Martin, Hixson, Tenn.; Landon Smith, Rossville, Ga.

[73] Assignee: Polysar Financial Services, S.A., Fribourg, Switzerland

[21] Appl. No.: 172,437

[22] Filed: Mar. 24, 1988

[51] Int. Cl.[4] ..... B32B 31/12; B32B 31/20

[52] U.S. Cl. ..... 156/324; 156/327; 156/333; 156/334; 428/95

[58] Field of Search ..... 156/72, 78, 324, 327, 156/333, 334; 428/95

[56] References Cited

U.S. PATENT DOCUMENTS

| | | | |
|---|---|---|---|
| 4,406,310 | 9/1983 | Reader et al. | 428/95 X |
| 4,437,918 | 3/1984 | Morohashi et al. . | |
| 4,595,617 | 6/1986 | Bogdany . | |
| 4,634,730 | 1/1987 | Bogdany . | |
| 4,661,380 | 4/1987 | Tillotson | 428/95 X |
| 4,702,950 | 10/1987 | Slosberg et al. | 428/95 |
| 4,731,143 | 3/1988 | Cross | 156/231 |
| 4,743,330 | 5/1988 | Tillotson | 156/324 |

FOREIGN PATENT DOCUMENTS 0171201 2/1986 European Pat. Off. .

*Primary Examiner*—Robert A. Dawson

*Attorney, Agent, or Firm*—Stevens, Davis, Miller & Mosher

[57] ABSTRACT

A removable foam backed carpet may be prepared by laminating a non-woven scrim, having a cohesive strength less than the cohesive strength of the foam, to the back of a foam backed carpet. The foam backed carpet is gelled, crushed and vulcanized to produce a resilient backing having a good delamination strength. The carpet is particularly useful when it is cut into tiles. The carpet tile may be easily removed to install wiring of if wear is excessive.

11 Claims, 1 Drawing Sheet

METHOD OF MAKING A CARPET

FIELD OF THE INVENTION

This invention relates to a process for producing an improved laminate foam backed carpet, wherein the improvement comprises adhering over the foam backing a non-woven scrim material having a cohesive strength less than the cohesive strength of the foam backing.

BACKGROUND OF THE INVENTION

Processes for the manufacture of carpet material in general, and carpet tiles in particular, are well known in the art —see for example U.S. Pat. Nos. 4,437,918, 4,595,617, 4,634,730 and published European Patent Application No. 171 201.

A typical carpet material may generally comprise:

(i) fibrous carpet material, (ii) a thermoplastic composition which is laminated on the back of (i), and (iii) a foamed compound which is laminated over (ii) to a specified thickness and serves as the backing for the carpet material.

Installation of the carpet material can be achieved through numerous techniques, one of which employs the use of adhesive compounds to hold the carpet material in place.

After installation of the carpet, there usually arises a need for its removal due to carpet wear, installation of floor wiring under the carpet and the like. In the removal of the carpet, foam delamination from the carpet is a problem which usually occurs. Foam delamination occurs because the adhesion between the foamed backing and the floor is greater than the internal cohesive strength of the foamed backing and results in substantial amounts of foam backing remaining adhered to the floor. Methods to remove the foamed compound which remains adhered to the floor can be manpower and/or equipment intensive, giving rise to added expense. The improved foam backed carpet produced by the process of the present invention seeks to overcome the problem of foam delamination from the carpet material during removal.

Accordingly, it is an objective of the present invention to provide a process for the production of an improved laminate foamed carpet, which carpet, after installation and removal, will exhibit significantly reduced foam delamination.

SUMMARY OF THE INVENTION

The present invention relates to a process for producing a laminate foam backed carpet which comprises adhering over a foam backing a non-woven scrim material having a cohesive strength less than the cohesive strength of said foam backing, said process comprising:

(a) applying from about 30 to about 70 ounces per square yard of a foamed latex compound to a precoated carpet, said foamed compound comprising, per 100 parts by weight of one or more rubbery polymers selected from the group consisting of:

(i) polymers comprising from about 20 to about 80 parts by weight of a $C_8$–$C_{12}$ vinyl aromatic monomer which is unsubstituted or substituted by a $C_1$–$C_4$ alkyl radical or a chlorine or bromine atom and from about 20 to about 80 parts by weight of a $C_4$–$C_6$ conjugated diolefin which is unsubstituted or substituted by a chlorine atom, and (ii)polymers comprising co or homo polymers of $C_{4-6}$ conjugated diolefins which are unsubstituted or substituted by a chlorine atom, up to about 200 parts by weight of a mixture comprising particulate inorganic filler, a gelling system and a cure paste;

(b) applying said non-woven scrim material over said foamed compound thus forming a laminate carpet material, (c) subjecting said foamed compound to a heat treatment at a temperature of from about 70° to about 85° C. for a period of from about 1 to about 5 minutes to gell said foam;

(d) compressing said laminate carpet material; and (e) vulcanizing and drying said compressed laminate carpet material by subjecting it to a temperature of from about 100° to about 150° C. for a period of from about 10 to about 30 minutes.

DETAILED DESCRIPTION OF THE INVENTION

Figure 1:
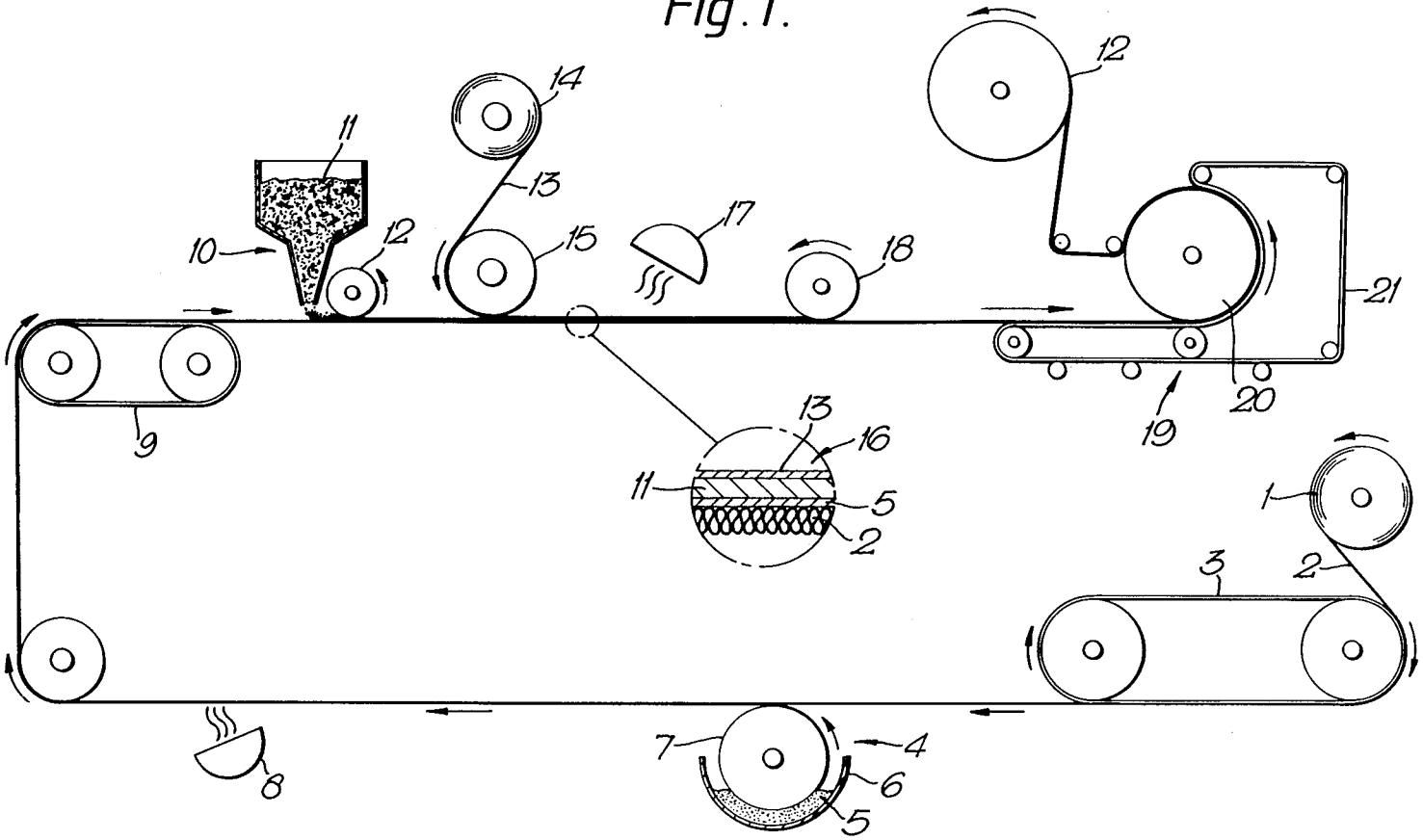
FIG. 1 is a schematic view illustrating an embodiment of the process for producing a laminate foam backed carpet according to the present invention.

The pre-coated base carpet material suitable for use in this invention is not specifically restricted. Accordingly, the carpet may be selected from the group consisting of: woven carpets, knitted carpets, tufted carpets, needlepunched carpets and the like. Such carpets are well known and are typically prepared from natural fibers such as wool, cotton, hemp or the like, synthetic fibers such as polypropylene, polyester, polyamide, polyacrylate, polyvinylidene chloride or the like and other fibrous materials of flat yarn. Typically the yarn is sewn through a back sheet which may be woven, as in jute backing or may be an extruded sheet such as polypropylene.

The foamed compound suitable for use in the present invention, which is used in an amount of from about 30 to about 70 ounces per square yard of carpet material, generally comprises:

(i) a latex of a rubbery polymer, (ii) at least one particulate inorganic filler, (iii) a gelling system, and (iv) a cure paste.

Specifically, the latex preferably contains from about 60 to about 75 percent by weight of rubbery solids selected from the group consisting of polymers comprising, (a) from about 20 to about 80, preferably from about 40 to about 60, parts by weight of a $C_8$–$C_{12}$ vinyl aromatic monomer which is unsubstituted or substituted by a $C_1$–$C_4$ alkyl radical or a chlorine or bromine atom, and (b) from about 20 to about 80, preferably from about 40 to about 60, parts by weight of a $C_4$–$C_6$ conjugated diolefin which is unsubstituted or substituted by a chlorine atom, and co or homo polymers of $C_{4-6}$ conjugated diolefins which are unsubstituted or substituted by a chlorine atom.

Suitable vinyl-aromatic monomers incude styrene or alpha-methylstyrene, most preferably styrene. Suitable diolefins include 1,3-butadiene, isoprene or chloroprene, most preferably 1,3-butadiene. The latex polymer may comprise a mixture of natural and synthetic latices in a dry weight ratio from 20:80 to 80:20, preferably 40:60 to 60:40.

Fillers suitable for use in the foamed compound comprise a particulate, inorganic material. Suitable fillers include, but are not limited to, calcium carbonate, glass microspheres, dolomite, talc, barytes (barium sulfate), clay and aluminum trihydrate. Preferably, the filler is selected from the group consisting of barium sulfate, calcium carbonate, aluminum trihydrate and mixtures thereof. The amount of filler used is up to about 200 preferably from about 50 to about 150, parts by weight per 100 parts by weight of rubbery solids.

The gelling system suitable for use in the foamed compound may be selected from the group consisting of:

(i) up to about 2 parts by dry weight per 100 parts by weight latex of an ammonium or alkali metal silicofluoride, and (ii) a zinc or cadmium compound in an amount sufficient to provide from about 0.5 to about 10 parts by weight of zinc or cadmium compound ions per 100 parts by weight of said latex and sufficient ammonia or ammonium ion releasing compound to provide from about 0.1 to about 4 parts by weight of ammonia or ammonium ion per 100 parts by weight of said latex.

The preferred silicofluorides are ammonium, sodium and potassium silicofluoride. For the ammonia metal ion gelling systems the preferred metal ion is zinc, which is usually present in the compound as part of the cure paste. Suitable ammonium ion releasing compounds may include, but are not limited to, ammonium acetate, ammonium chloride and ammonium sulphate.

The gelling systems described above may be used in conjunction with an agent to broaden the conditions under which the compound gels (gel sensitizer). These agents improve processing and foam characteristics. Such agents are selected from the group consisting of: ammonium sulphamate, ammonium sulphate, $C_1$–$C_4$ amine sulphamates and $C_1$–$C_4$ amine sulphates. These agents may be used in amounts up to about 3 parts by weight per 100 parts by weight of rubber solids. Preferably the agent is used in amounts of from about 0.2 to about 0.6 parts by weight per 100 parts by weight of rubber solids.

The cure paste suitable for use in the foamed compound is not particularly restricted and generally contains one or more curing agents in amounts well known in the art.

The non-woven scrim suitable for backing the carpet in the present invention is a sheet material which may be prepared from either natural or synthetic fibers. An example of a natural fiber is cotton. Examples of synthetic fibers may include nylon, polyethylene, polypropylene, polyesters and polyamides. Preferably, the non-woven scrim suitable for use in the present invention is a fabric material which is prepared from synthetic, more preferably polyethylene, polypropylene, nylon, polyester or glass, fibers. In a preferred embodiment the non-woven scrim may be characterized by having a weight of from about 2 to about 5.5 ounces per square foot (80 to 180 L g/m$^2$).

In a preferred embodiment of the present invention, the carpet is not pre-coated and, accordingly, a pre-coat procedure is incorporated into the process of the present invention. Such a procedure comprises the application of a pre-coat compound to the carpet base material prior to the application of the foamed compound described above. The pre-coat compound contains from about 40 to about 75 weight percent of rubbery solids and may comprise: one or more of the above noted polymers, or a latex of a carboxylated rubbery polymer and at least one particulate, inorganic filler. The carboxylated polymer in the latex may comprise per 100 parts by weight of rubbery polymer:

(a) from about 10 to about 80, preferably from about 35 to about 60, parts by weight of a $C_8$–$C_{12}$ vinyl aromatic monomer which is unsubstituted or substituted by a $C_1$–$C_4$ alkyl radical or a chlorine or bromine atom, (b) from about 20 to about 80, preferably from about 40 to about 60, parts by weight of a $C_4$–$C_6$ conjugated diolefin, which is unsubstituted or substituted by a chlorine atom, and (c) up to about 10, preferably less than 5, parts by weight of one or more monomers selected from the group consisting of $C_3$–$C_6$ ethylenically unsaturated carboxylic acids and amides of $C_3$–$C_6$ ethylenically unsaturated carboxylic acids, which amides are unsubstituted or substituted at the nitrogen atom by up to two radicals selected from the group consisting of $C_1$–$C_4$ alkyl radicals and $C_1$–$C_4$ hydroxy alkyl radicals.

Preferably, (a) is styrene, (b) is 1,3-butadiene and (c) is a monomer chosen from the group consisting of itaconic acid, methacrylic acid and fumaric acid acrylamide, and N-methylol acrylamide. The filler suitable for use in the pre-coat compound is a particulate, inorganic material as described above. Preferably, the filler is calcium carbonate. The amount of filler used is from about 100 to about 1500, preferably less than 1000, parts by weight per parts by weight of rubbery solids.

In another preferred embodiment of the present invention, the laminate foam backed carpet is passed, after vulcanization and cooling, to a cutting station section wherein said laminate foam backed carpet is cut into carpet tiles.

In yet another preferred embodiment of the present invention, a reticulated glass fibrous material may be applied over the pre-coated carpet prior to the application of the foamed compound and serves to add dimensional stability to the finished carpet. This is particularly important for carpet tiles.

The present invention will be more readily appreciated by reference to the accompanying drawing. FIG. 1 is a schematic view illustrating an embodiment of the process for producing a laminate foam backed carpet according to the present invention wherein the arrows indicate the direction of movement of the carpet. As shown in FIG. 1, a base carpet material 2 is withdrawn from an unwind station 1 and travels by means of a conveyor 3 to a pre-coat application section 4, wherein pre-coat compound 5, contained in pan 6, is applied to the back of the carpet by means of a roller 7 or the like. The type of pre-coat applicator suitable for practicing the present invention is not particularly restricted. Thereafter, the pre-coated carpet base material enters a pre-heat section 8 wherein said pre-coated carpet base material is heated to a temperature of from about 90° to about 100° C. The heat may be supplied in the form of microwave, infrared or thermal radiation. Next, the pre-coated carpet base material travels by means of a conveyor 9 to a foam application section 10, wherein the foamed compound 11 is applied to the pre-coated carpet base material by means of a doctor roller 12 or the like. The type of foam applicator suitable for practicing the present invention is not particularly restricted. Thereafter, the non-woven scrim material 13 is withdrawn from an unwind station 14 and laminated on the carpet material by means of a roller 15 to form a laminated carpet material 16, such that said non-woven scrim material 13 is applied to the upper surface of the foam backing compound 11. Next, the laminated carpet material 16 enters a gelling station 17 wherein said foamed compound 11 is gelled - gelling of the foam backing 11 may be achieved by exposure to microwave, infrared or thermal radiation. Thereafter, the laminated carpet material is compressed by a roller 18, afterwhich it enters a drum laminator 19 comprising (i) a drum 20 maintained at a temperature of from about 100° to about 150° C., preferably from 110° to 130° C. which serves to both the dry laminated carpet material and vulcanize the foamed compound therein, and (ii) a conveyor belt system 21 which concurrently compresses the laminate carpet material.

The finished laminate foam backed carpet is then cooled and passed to a reroll machine 22, or to a cutting station (not shown) wherein the laminate foam backed carpet is cut into smaller pieces for use as carpet tiles. Generally, the time it takes for the carpet to travel around the drum laminator will range from about 0.5 to about 5, preferably 1 to 3 minutes.

The resulting tiles may then be installed over a subfloor. Generally the carpet or carpet tile will be glued in place. The delamination strength of the adhesive should be not less than 5, preferably at least 7 lb/square inch dry and not less than 3.5, preferably at least 6 lb/square inch wet. These higher delamination strengths are best achieved when the foam is vulcanized in a compressed state in accordance with the present invention.

The following example is intended to illustrate the invention and not to limitit. In the example, parts are parts by dry weight unless otherwise specified.

EXAMPLE 1

A foamable compound was prepared using the following formulation:

| Compound | Dry Parts | |
|---|---|---|
| POLYSAR Latex 425 (styrene butadiene latex) | 60.0 | 100 |
| Natural Latex | (40.0) | |
| Fatty acid soap | 3.0 | |
| Ammonia | 1.0 | |
| filler ($BaSO_4$) | 125.0 | |
| Gel Sensitizer | 0.5 | |
| Electrolyte | 0.5 | |
| Colour | 0.5 | |

If necessary, water was added to obtain a solids content of 75 to 78 weight percent. The viscosity was adjusted to about 6000–7000 cps as measured with a #5 spindle at 20 rpm using a Brookfield viscometer.

To the above compound was added 9.9 parts by weight of a cure paste comprising:

| Compound | Dry Parts |
|---|---|
| Zinc Oxide | 4.0 |
| polymeric hindered phenol antioxidant | 0.9 |
| zinc salt of mercapto-benzothiozole | 1.25 |
| zinc diethyl dithiocarbamate | 1.0 |
| Sulfur | 1.65 |

-continued

| Compound | Dry Parts |
|---|---|
| Stabilizer (DPC) | 1.00 |

A pre-coat compound was prepared as follows:

| Compound | Dry Parts |
|---|---|
| POLYSAR Latex 425 | 60. |
| Natural Latex | 40. |
| Mixed filler clay/$BaSO_4$ | 200. |
| Fatty acid soap | .5 |
| cure paste | 11.6 |

Thickener to provide a viscosity of 10,000 to 11,000 cps measured on #5 spindle on a Brookfield viscometer at 20 rpm. Water to 80.6 percent solids.

A 22"×22" piece of carpet was coated on its back at a rate of 30 oz/yd $^2$ of the pre-coat compound. The coated compound was partially dried for 5 minutes in a hot air circulating oven at 275° F. The foamable compound and cure paste were mixed and frothed to a density of from 350 to 550 g/l. Two and a half parts by dry weight per 100 parts of polymer of a gelling system comprising sodium silicosulfate and ammonium sulfamate in a dry weight ratio of 2.0:0.5 were added to the foamed compound. The foamed compound was applied to the pre-coated compound at ¼" thickness (wet). A 22"×22" polypropylene felt was laid over the wet foam and the foam was gelled. The foam was crushed with a crush roller to less than half its original thickness. The resulting carpet was then dried, vulcanized in the crushed state and allowed to cool in a flat position.

The sample could be glued to a substrate and was sufficiently well adhered to not slip easily. The carpet could be torn from the substrate by delaminating the felt back without delamination of the foam backing.

What is claimed is:

1. A process for producing a laminate foam backed carpet which comprises adhering over a foam backing a non-woven scrim material having a cohesive strength less than the cohesive strength of said foam backing, said process comprising:

(a) applying from about 30 to about 70 ounces per square yard of a foamed latex compound to a pre-coated carpet, said foamed compound comprising per 100 parts by weight of one or more rubbery polymers selected from the group consisting of:

(i) polymers comprising: from about 20 to about 80 parts by weight of a $C_8$–$C_{12}$ vinyl aromatic monomer which is unsubstituted or substituted by a $C_1$–$C_4$ alkyl radical or a chlorine or bromine atom and from about 20 to about 80 parts by weight of a $C_4$–$C_6$ conjugated diolefin which is unsubstituted or substituted by a chlorine atom; and (ii) polymers comprising co or homo polymers of $C_{4-6}$ conjugated diolefins which are unsubstituted or substituted by a chlorine atom and up to about 200 parts by weight of at least one filler selected from the group consisting of calcium carbonate, glass microspheres, dolomite, talc, barytes, clay and aluminum trihydrate, a gelling system and a cure paste;

(b) applying said non-woven scrim material over said foamed compound thus forming a laminate carpet material, (c) subjecting said foamed compound to a heat treatment to a temperature of from about 70° to about 85° C. for a period of from about 1 to about 5 minutes to gell said foam;

(d) compressing said laminate carpet material;

(e) vulcanizing and drying said compressed laminate carpet material by subjecting it to a temperature of from about 100° to about 150° C. for a period of from about 10 to about 30 minutes.

2. The process of claim 1, wherein said non-woven scrim material comprises a fabric material prepared from at least one synthetic fiber selected from the group consisting of polyethylene, polypropylene, nylon and polyester.

3. The process of claim 2 wherein said foamed compound is prepared from a latex which contains from about 60 to about 75 percent by weight of rubbery solids comprising per 100 parts by weight of rubbery polymer consisting of from about 40 to about 60 parts by weight of styrene and from about 40 to about 60 parts by weight of butadiene, and from about 50 to about 150 parts by weight of at least one of said fillers, a gelling system and a cure paste.

4. The process of claim 3 wherein said gelling system is selected from the group consisting of (i) up to about 2 parts by dry weight per 100 parts by weight latex of an ammonium or alkali metal salt of silicofluoride, and (ii) a zinc or cadmium compound in an amount sufficient to provide from about 0.5 to about 10 parts by weight of zinc or cadmium ions per 100 parts by weight of said latex and sufficient ammonia or ammonium ion releasing compound to provide from about 0.1 to about 4 parts by weight of ammonia or ammonium ion per 100 parts by weight of said latex.

5. The process of claim 4 wherein there is added to said latex up to about 3 parts by dry weight per 100 parts by weight latex of a compound selected from the group consisting of ammonium sulphamate, ammonium sulphate, $C_{1-4}$ amide sulphamates and $C_{1-4}$ amine sulphates.

6. The process of claim 5 wherein a pre-coat compound is applied to said carpet material prior to the application of said foam compound, said pre-coat compound containing from about 40 to about 75 weight percent of rubbery solids comprising, per one hundred parts by weight of polymer: from about 10 to about 80 parts by weight of a $C_8$–$C_{12}$ vinyl aromatic monomer which is unsubstituted or substituted by a $C_1$–$C_4$ alkyl radical or a chlorine or bromine atom, from about 20 to about 80 parts by weight of a $C_4$–$C_6$ conjugated diolefin which may be unsubstituted or substituted by a chlorine atom; from 0 to about 10 parts by weight of at least one monomer selected from the group consisting of $C_3$–$C_6$ ethylenically unsaturated carboxylic acids and amides of $C_3$–$C_6$ ethylenically unsaturated carboxylic acids, which amides may be unsubstituted or substituted at the nitrogen atom by up to two radicals selected from the group consisting of $C_1$–$C_4$ alkyl radicals and $C_1$–$C_4$ hydroxy alkyl radicals; and from about 100 to about 1500 parts by weight of at least one particulate inorganic filler.

7. The process of claim 6 wherein a reticulated glass fibrous material is applied over said pre-coat compound prior to the application of said foam backing compound.

8. The process of claim 7 wherein said laminate carpet material is subjected to compression followed by heat treament at a temperature of from about 100° to about 150° C. for a period of from about 1 to about 3 minutes in a hot air oven.

9. The process of claim 1 wherein said laminate carpet material is subjected to compression followed by heat treatment at a temperature of from about 100° to about 150° C. for a period of from about 1 to about 3 minutes in a hot air oven.

10. The process of claim 8 wherein a drum laminator is used to both compress and vulcanize said laminate foamed carpet, and said drum is operated at a temperature of from about 110° to about 130° C.

11. The process of claim 9 wherein a drum laminator is used to both compress and vulcanize said laminate foamed carpet, and said drum is operated at a temperature of from about 110° to about 130° C.

* * * * *